United States Patent [19]

Wanson

[11] 4,029,056

[45] June 14, 1977

[54] COMPACT INDIRECT HEATING VAPOR GENERATOR

[76] Inventor: Leon Jacques Wanson, 118 Avenue Isidore Gheyskens, 1600 Brussels, Belgium

[22] Filed: Jan. 16, 1976

[21] Appl. No.: 649,675

[52] U.S. Cl. ..... 122/34; 122/248; 122/406 R

[51] Int. Cl.[2] ..... F22B 1/02; F22D 7/12; F22B 27/08

[58] Field of Search ..... 122/32, 33, 34, 248, 122/250 R, 406 R, 451 R

[56] References Cited

UNITED STATES PATENTS

| | | | |
|---|---|---|---|
| 3,215,126 | 11/1965 | Sprague | 122/451 |
| 3,398,721 | 8/1968 | Zangl | 122/33 |
| 3,529,579 | 9/1970 | Wanson | 122/248 |
| 3,613,643 | 10/1971 | Barratt | 122/406 |
| 3,682,140 | 8/1972 | Roffler | 122/34 |

*Primary Examiner*—Kenneth W. Sprague
*Attorney, Agent, or Firm*—Young & Thompson

[57] ABSTRACT

A vapor generating apparatus operating with a small quantity of fluid which comprises in a single unit a heater including a plurality of similarly shaped tubes arranged in one or several coaxially extending layers each comprised of a number of successive sets of adjacent coils for circulating a heat transfer fluid, and a boiler including a bundle of vertically extending tubes for circulating the heat transfer fluid discharged from the heater, said tubes lying within the liquid to be evaporated, the boiler being arranged with a vapor/liquid separator connected at the vapor outlet and control means adapted such that a continuous flow of dry vapor at the separator outlet without a separation plane between liquid and vapor phases being formed.

10 Claims, 3 Drawing Figures

COMPACT INDIRECT HEATING VAPOR GENERATOR

Figure 1:
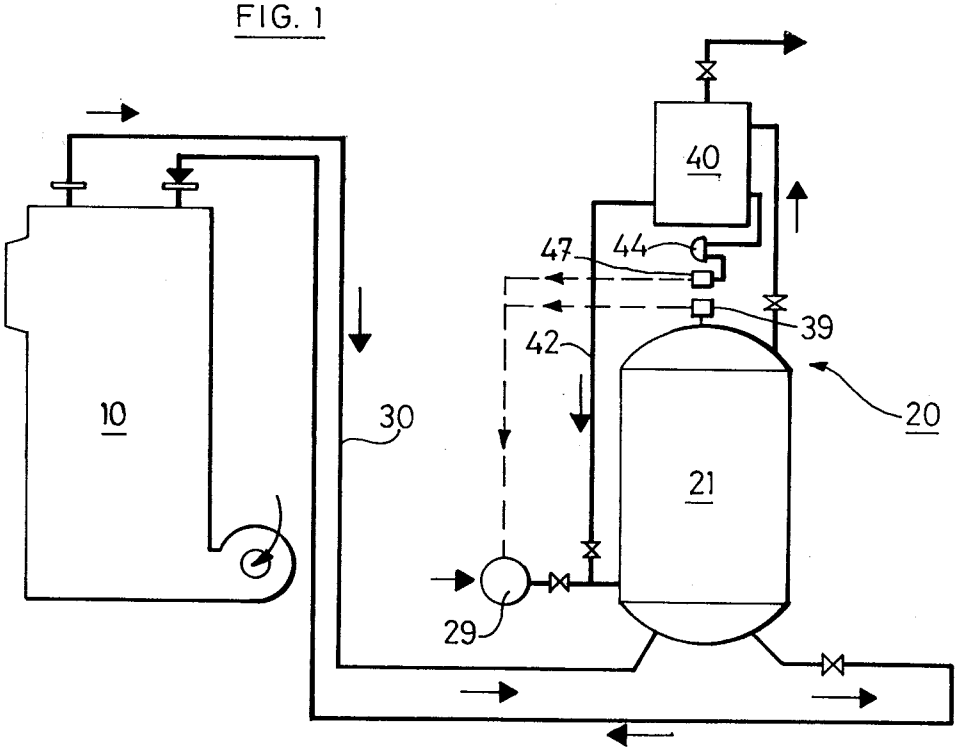

The present invention relates to a compact indirect heating vapor generating apparatus operating with a very low quantity of water.

Indirect heating boilers are known in which the vapor is produced by heat exchange between water and a heating fluid in tubular or plate heat exchangers lying in a volume of water. Generally the water tank should have a great volume resulting in the boiler having a great inertia so that the boiler can not reach its normal operation unless a substantial period of time has elapsed. Furthermore, the high volume of water which is necessary for operation results in risk of bursting of the boiler due to the accumulated energy in the said volume of water, and in the necessity of using more expensive, relatively thick steel plates.

A boiler operating with a very low quantity of water has been described in Belgian Pat. No. 782,569. The boiler disclosed therein is arranged with a vapor/liquid separator means connected at the vapor outlet of a heat exchanger and control means for controlling the cold water feed; said control means being responsive to a sensing means indicating the presence and/or pressure of vapor at the exchanbe outlet, said sensing means being adjusted such that a continuous flow of dry vapor is present at the separator outlet at any time without a separation plane between liquid and vapor phases being formed. This boiler obviates the above menioned drawbacks of the prior art boilers. However, a boiler as disclosed in said patent must be operated by the heating energy from a suitable heat transfer fluid and consequently proper feeding must be provided for said heat transfer fluid. Where it is desirable to produce high pressure vapor directly from a cold fluid as commercially available the boiler as described above can not be used unless additional equipment is provided for heating the fluid to be used as heating means in the boiler. This results in additional cost and requires additional floor-space. As regards operation, such an installation suffers from such a bad thermal inertia that the installation can not be put into normal operation rapidly.

The object of the invention is a compact indirect heating vapor generating apparatus which can be put in normal operation very rapidly, which can be constructed and installed relatively easily and inexpensively while being highly safe in operation.

The invention consists in arranging in a single unit a boiler as described above and a heater for a heat transfer fluid which operates with a small quantity of fluid and produces a high temperature fluid at atmospheric pressure. Advantageously, the heater is of the type disclosed in U.S. Pat. No. 3,529,579. It has been found that the combination of said heater with the said boiler results in a far better operation than would be obtained by using the boiler with any other known type of heater, even for producing vapor at a pressure as high as 1000 PSI at 545° F. It is believed that the novel effect obtained by the inventive apparatus results from the combination of the heater containing a small quantity of fluid and producing a heat transfer fluid at high temperature (600° F) under atmospheric pressure with the boiler operating with a small quantity of water and having a relatively reduced evaporation surface.

Figure 2:
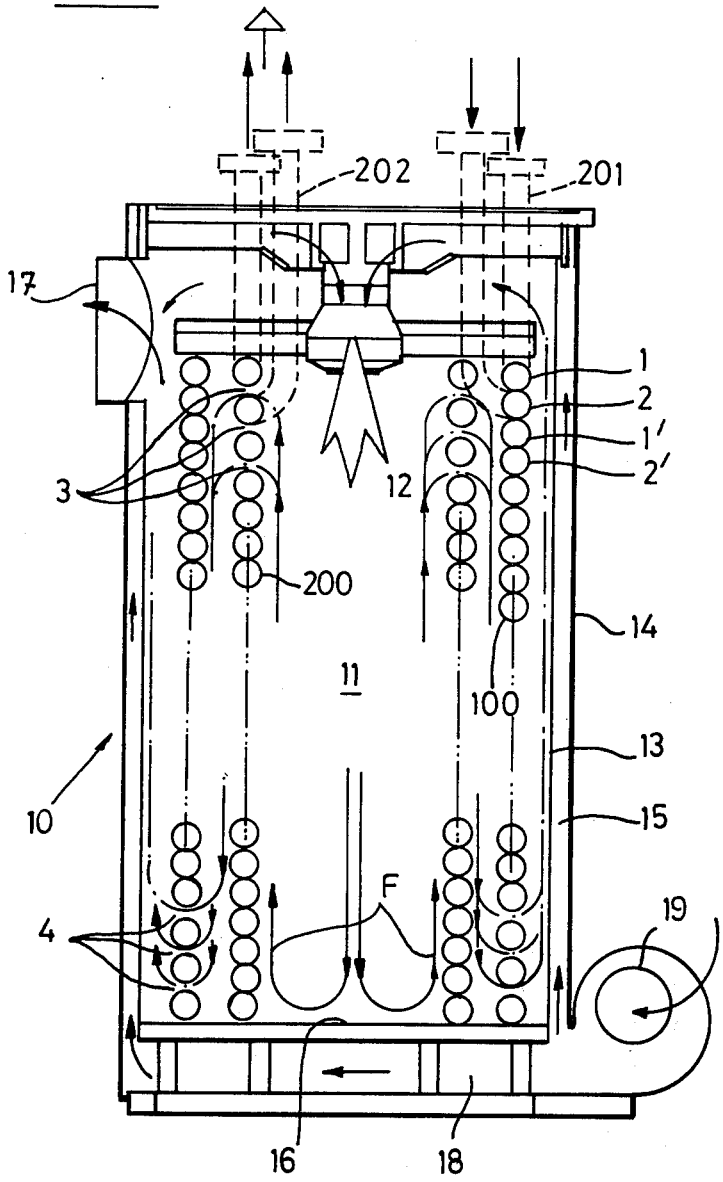
Figure 3:
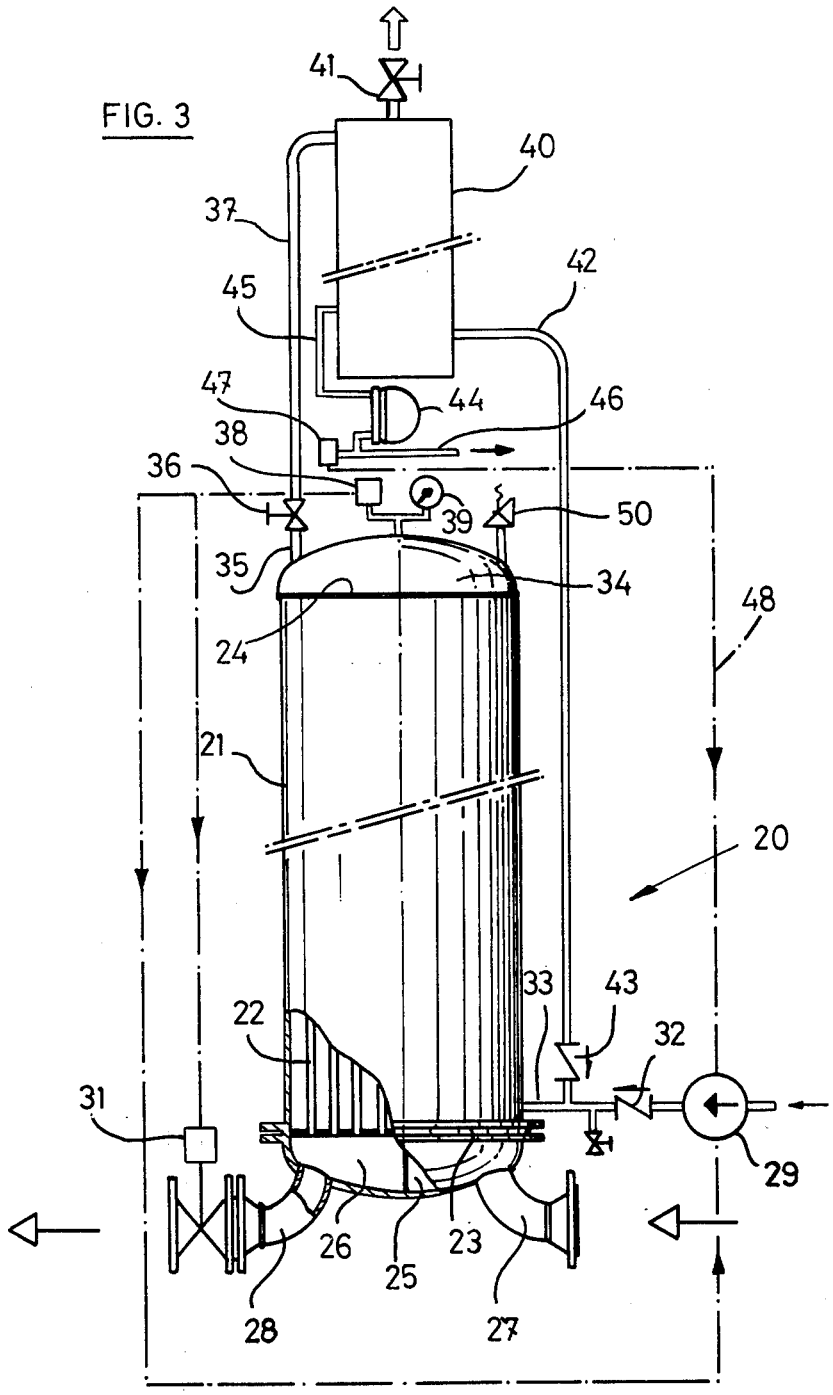

In the appended drawings:

FIG. 1 schematically represents the apparatus of the invention;

FIG. 2 schematically shows a sectional view of the heater;

FIG. 3 schematically shows the structure of the boiler.

Referring to FIG. 1, there is schematically depicted an indirect vapor generating apparatus shown as essentially comprising a heater 10 and a boiler 20, both components being included in a common unit (not shown).

The heater 10 is arranged to heat a heat transfer fluid (e.g. oil or synthetic fluid) to a suitable high temperature, such as 600° F, for boiling a liquid (e.g. water) by heat exchange in the boiler 20 in order to produce a desired quantity of vapor.

As illustrated more particularly in FIG. 2, the heater 10 comprises a plurality (illustratively two) of layers 100, 200, each including two coaxially coiled tubes for circulating the heat transfer fluid to be heated. The internal layer defines the peripheral wall of a fire box 11 provided with a central burner 12 on one end thereof. The opposite end 16 of the fire box is closed. The adjacent successive coils 1, 2 of the external layer 100 are connected to inlet tubes such as 201. The next following coils 1′, 2′ are connected to the preceding ones in the same order, coil 1 being continued by coil 1′, coil 2 being continued by coil 2′ and so on. The general flowing direction is from top to bottom as viewed in FIG. 1 in the layer 100, then from bottom to top in 200. The heated fluid is discharged from the coils placed at the top end of layer 200 by means of tubes such as 202. At the inlet and outlet side of the heater, the individual tubes are separated thereby enabling each thereof to be fitted with one or several individual control devices arranged to measure the temperatures and/or flow-rates for controlling the burner. An absolute reliability and safety is thus achieved. Beyond the control devices, the tubes may be connected to a common collector such as conduit 30. Layer 100, which is fed with cold fluid, is surrounded by a first sheet jacket 13. A second jacket 14 surrounds the jacket 13 with an annular space 15 between them.

The fumes are returned by the end 16 of the fire box 11 as indicated by arrows F and they escape the fire box through passages 3 formed between the adjacent first coils of layer 200 on the burner side of the fire box. The fumes then flow along the annular space extending between layers 100 and 200 and are escaping said annular space through passages 4 between the last coils of layer 100. Said passages 4 are located on the opposite side of the fire box relative to passages 3. Finally, the fumes are exhausted through exhaust aperture 17.

The end of space 15 at its end opposite to the burner side, is connected to an air inlet chamber 18 which is fed by the fan 19. The air fed by said fan 19 proceeds to the burner while being preheated, its temperature increasing as it proceeds along the jacket 13, by heat exchange with the fumes circulating in the opposite direction.

In the embodiment described in the foregoing, the tubes have the same diameter all over and the speed of the fluid therein is the same all over. However, some tubes may be chosen with different diameters provided that the Reynolds numbers are kept constant.

According to a variation to the illustrative embodiment, each layer of coiled tubes may be formed at one end of the heater as a flat coil (pancake) extending in a plane perpendicular to the symmetry axis of the heater and wherein the tubes are arranged symmetrically with one another by rotation about the intersection point of said symmetry axis with the plane of said flat coil. Such pancakes might form successive intermediate layers adapted for transferring the fluid from the tubes of the external layer to the tubes of the internal layer.

The boiler 20 is illustrated more particularly in FIG. 3. It comprises a vertical cylindrical shaped heat exchanger 21 comprising a bundle of U-shaped tubes 22 in which is circulated the heat transfer fluid conducted by conduit 30 from heater 10. The tubes extend vertically and their ends open outside a lower head plate 23 into a fluid inlet chamber 25 and anoutlet chamber 26 respectively. The inlet chamber 25 is connected by piping 27 to conduit 30. The outlet chamber 26 is connected to outlet pipe 28 which is arranged with an electromagnetic valve means 31 driven by pressure and flow rate control means. The space between lower head plate 23 and an upper chamber 34 and surrounding the tubes 22 forms the evaporation space which is fed with liquid to be evaporated supplied by pump means 29. A non-return valve 32 is provided between the pump means 29 and the inlet pipe 33 to the evaporation space.

The head plate 24 defines in the upper portion of the envelope 21 a collecting chamber 34 which communicates with the evaporation space. Said collecting chamber 34 has an exhaust aperture 35 for discharging the generated vapor together with some entrained feed liquid through valve means 36 and conduit 37 to a separator unit 40. As usual the exchanger 21 is also provided with pressure control means 38, pressure indicator means 39 and safety valve means 50.

The separator unit has a cylindrical shape. At the upper portion thereof is connected tangentially therewith the conduit 37 conducting the vapor/liquid compound discharged from the exchanger 21. The vapor is exhausted from the upper portion through valve 41 while the liquid is collected at the lower portion for being recycled through line 42 which is provided with a non-return valve means 43. Reference 44 denotes a blow-off gear fed by conduit 45 connected to the separator unit 40 at a level adjacent the uppermost level of the liquid which is curling inside the separator unit (approximately a quarter of the height thereof). Said blow-off gear 44 exhausts the liquid through conduit 46 which is arranged with a pressure sensing means 47. The latter controls the feed pump means 29 as symbolically represented by phantom line 48 thereby to cause the pump means 29 to be stopped when the pressure sensed exceeds a predetermined level. Thus the pump 29 operates intermittently and the adjustment ought to be made such that the produced vapor/liquid compound is immediately discharged from exchanger 21 through conduit 37 to separator 40 without that any separation plane between the liquid and the vapor is formed at no time in the exchanger.

The presence of liquid at the outlet of the blow-off gear 44 can also be stated by sensing the temperature of the liquid.

The pressure of the produced vapor can also be sensed directly at the exchanger outlet as indicated above with said pressure control means 38. The latter can also serve to control the feed pump means 29. It is to be noted that the electromagnetic valve 31 may be replaced by a pump means which would be stopped when the pressure sensed by said pressure control means 38 increases. Also to be noticed that the pressure control means 38 modulates the heat exchange through the electromagnetic valve 31 or a like device.

It is to be noticed that the feedwater system is designed to get the best efficiency out of the exchanger in conjunction with continuous blowdown to limit the total dissolved solids content which could increase very quickly owing to the small water volume of the boiler.

What is claimed is:

1. A vapor generating apparatus comprising:

a. heater means comprising a plurality of similarly shaped tube means circulating a heat transfer fluid, arranged in at least one coaxially extending layer, each layer being comprised of a number of successive sets of adjacent coils, the most internal layer defining a fire box having a cylindrical side wall and having first and second ends, a central burner means adjacent to said first end of the fire box and having at least one inlet for combustion-supporting air, a first end wall for said fire box connected to said side wall at the second end thereof, an annular chamber means surrounding said tube means and extending lengthwise thereof for circulating said combustion-supporting air to said inlet therefor in heat exchange relationship with the combustion gases thereby to preheat said air prior its intake into the burner means, exhaust means connected to the fire box for exhausting the combustion gases from the fire box, discharge means connected to said tube means for the heat transfer fluid, and b. boiler means comprising heat exchanger means including tank means for the liquid to be evaporated, feed pump means for said liquid, and a bundle of vertically extending tubes connected to said discharge means for circulating the heat transfer fluid discharged from said heater means, said bundle of tubes lying within said liquid, separator means having its upper portion connected to the upper portion of said tank means for accepting the liquid/vapor compound discharged from said heat exchanger means and having its lower portion connected to an inlet for the feed liquid, said separator means further having exhaust means for vapor, and control means responsive to the presence and/or pressure of produced vapor for controlling said feed pump means for the liquid such that dry vapor is continuously exhausted from said separator means without any separation plane between liquid and vapor phases being formed at any time in said heat exchanger means.

2. A vapor generating apparatus according to claim 1, wherein said separator means is of the centrifuge type.

3. A vapor generating apparatus according to claim 1, wherein said sensor means comprises a pressure control means directly responsive to the vapor pressure at the exchanger outlet for shutting down the liquid feeding when said vapor pressure rises to a predetermined level.

4. A vapor generating apparatus according to claim 1, wherein a blow-off gear means is connected to said separator means at a point adjacent the possible uppermost level of the liquid in said separator means and said control means comprises means sensing the presence of liquid at the outlet of said blow-off gear for shutting down the liquid feeding when the vapor pressure at the exchanger outlet rises to a predetermined level.

5. A vapor generating apparatus according to claim 4, wherein said means for sensing the presence of liquid at the outlet of the blow-off gear comprises means responsive to the pressure of the liquid at said outlet of the blow-off gear.

6. A vapor generating apparatus according to claim 4, wherein said means for sensing the presence of liquid at the outlet of the blow-off gear comprises means responsive to the temperature of the liquid.

7. A vapor generating apparatus according to claim 3, wherein said pressure control means controls a flow-rate control means coupled at the inlet or outlet for the heating fluid in the exchanger means thereby to shut down the flow of said heating fluid when the produced vapor pressure reaches a predetermined level.

8. A vapor generating apparatus according to claim 7, wherein said flow-rate control means is an instant operating valve.

9. A vapor generating apparatus according to claim 7, wherein said flow-rate control means is a pump means.

10. A vapor generating apparatus according to claim 1, wherein said inlet means for feeding the liquid to be evaporated comprises a constant flow pump means.

* * * * *